US007785398B2

(12) United States Patent
Dewald, III et al.

(10) Patent No.: US 7,785,398 B2
(45) Date of Patent: Aug. 31, 2010

(54) DRYER AND DRYING APPARATUS WITH ENHANCED MOISTURE REMOVAL

(75) Inventors: Charles Robert Dewald, III, Morristown, TN (US); Thomas L. Cristello, West Orange, NJ (US)

(73) Assignee: Protégé Enterprises, Union, NJ (US)

( * ) Notice: Subject to any disclaimer, the term of this patent is extended or adjusted under 35 U.S.C. 154(b) by 241 days.

(21) Appl. No.: 11/797,941

(22) Filed: May 9, 2007

(65) Prior Publication Data

US 2008/0276802 A1 Nov. 13, 2008

(51) Int. Cl.
*B01D 53/06* (2006.01)

(52) U.S. Cl. ..... 95/106; 95/113; 96/134; 96/146; 96/147; 34/77; 34/80; 34/86

(58) Field of Classification Search ..... 95/106, 95/113; 96/134, 146, 147; 34/77, 80, 86; 62/94, 271

See application file for complete search history.

(56) References Cited

U.S. PATENT DOCUMENTS

| | | | |
|---|---|---|---|
| 2,913,832 | A | 11/1959 | Kaufman |
| 3,034,221 | A | 5/1962 | Tuck et al. |
| 3,043,015 | A | 7/1962 | Brucken |
| 4,057,907 | A | 11/1977 | Rapino et al. |
| 6,094,835 | A | 8/2000 | Cromer |
| 6,434,857 | B1 | 8/2002 | Anderson et al. |
| 2004/0045187 | A1 | 3/2004 | Curry et al. |

FOREIGN PATENT DOCUMENTS

| | | | |
|---|---|---|---|
| GB | 2 217 824 | A | 1/1989 |
| GB | 2 369 422 | A | 5/2002 |
| JP | 60-119992 | | 6/1985 |
| JP | 2007 222455 | | 6/2007 |
| WO | WO 93/21489 | | 10/1993 |
| WO | WO 2005/012624 | | 2/2005 |
| WO | WO 2006/062262 | A1 | 6/2006 |
| WO | WO 2007-094741 | A1 | 8/2007 |

OTHER PUBLICATIONS

International Search Report, dated Jul. 15, 2008.

*Primary Examiner*—Robert J Hill, Jr.
*Assistant Examiner*—Christopher P Jones
(74) *Attorney, Agent, or Firm*—Nixon IP Law, PLC; William F. Nixon

(57) ABSTRACT

A dryer and a drying apparatus attachable to a dryer are disclosed. A wheel having desiccant material is located in line and in close proximity with a heating element. The wheel includes a first portion positioned in an inlet air path and a second portion positioned in an outlet air path. The desiccant material removes water molecules from air within the inlet air path, and lowers the vapor pressure of the incoming air. In the outlet air path, heated air flows through the second portion to transfer energy to the desiccant material. The wheel rotates to change the desiccant material within the portions.

8 Claims, 5 Drawing Sheets

DRYER AND DRYING APPARATUS WITH ENHANCED MOISTURE REMOVAL

BACKGROUND OF THE INVENTION

The present invention relates to a dryer using heated air to dry items. More particularly, the present invention relates to a dryer using a desiccant wheel to enhance moisture removal from the air.

DISCUSSION OF THE RELATED ART

Clothes dryers basically work in the same manner. The dryer sucks in air from the surrounding area. The dryer heats the air using an electric heating element, a gas burner and the like. The air passes into a tumbler housed within the dryer once it is heated. The hot air evaporates water from the clothes as they spin inside the tumbler. The dryer then forces the water evaporated from the clothes along with the hot air outside its assembly. Typically, a vent allows the air and moisture to exit the room.

Articles, such as clothes, towels, rugs and the like, take a certain amount of time to dry. The amount of time varies according to the article being dried. Other factors to this time period are energy capacity of the heating element, efficiency of heat transfer, air flow capacity, vapor pressure and the like. Some of these factors may be beyond the control of the dryer, while others may be controlled or monitored to improved drying times and efficiency.

Dryers use the vapor pressure of the air in the home, laundry room, basement and the like, which can be less than desirable for drying articles. The grains of moisture in a home may range from about 45 to about 110 grains of water vapor per pound of air. Grains of water vapor per pound of air (grains/lb.) indicate the density measurement of water vapor in air. For example, 14 cubic feet of air is about 1 pound (lb) of air. Approximately 7000 grains of water vapor are in about one lb. of air. By measuring the volume of air, an average number of grains of water vapor for the volume may be determined.

The air sucked into the dryer is heated during the time period for drying the articles. The higher the grains/lb. of water in the air, the longer the drying period. For example, air having about 110 grains/lb. may take twice as long as air having about 45 grains/lb.

SUMMARY OF THE INVENTION

The disclosed embodiments of the present invention relate to a dryer apparatus that improves drying efficiency and reduces the amount of time needed to dry articles within the apparatus. The dryer removes moisture from the air prior to entering the tumbler or housing with the dryer that holds the articles. The disclosed embodiments of the present invention seek to improve the condition of the air moisture prior to drying.

If the grains per pound of water vapor of the air to be heated are low, then the articles within the dryer are dried faster. The relationship is established because the vapor pressure is reduced by less grains/lb., which results in a quicker drying period. Thus, the time to dry an article is reduced. Preferably, a grain count of about 10 to 40 grains/lb. reduces the drying period to about a third of the normal drying period.

Vapor pressure dictates how much energy is needed to evaporate the water from the drying article. A certain amount of energy, such as about 1060 British Thermal Units (BTUs), is needed to evaporate 1 pound of air. Reducing the vapor pressure in that air would reduce the amount of energy needed to evaporate the pound of air. Vapor pressure may vary according to location and other conditions, but it can almost always be reduced. The disclosed embodiments of the present invention relates to reducing the vapor pressure in air so as to generate better air for drying clothes and lower costs. Thus, the disclosed embodiments of the present invention reduces the grains/lb of the air flowing into the dryer from the outside to improve drying times and efficiency.

According to the present invention, a dryer is disclosed. The dryer includes an inlet air path. The dryer also includes an outlet air path. The dryer also includes a wheel holding a desiccant material having a first portion placed in the inlet air path and second portion placed in the outlet air path. The first portion places the desiccant in the inlet air path.

According to the present invention, an apparatus to change air for drying an article also is disclosed. The apparatus includes a wheel positioned in an inlet air path that allows incoming air to flow over the article. The apparatus also includes desiccant material located within the wheel and positioned in the inlet air path. The desiccant material removes at least one water molecule from air in the inlet air path.

According to the present invention, a method for enhancing moisture removal also is disclosed. The method includes positioning a desiccant within a wheel into an inlet air path. The method also includes removing at least one water molecule from air within the inlet air path. The method also includes transferring energy from heated air within an outlet air path to the desiccant to facilitate the removing step.

According to the present invention, a drying apparatus also is disclosed. The drying apparatus includes a desiccant wheel having pellets in a first portion to remove at least one water molecule from air within an inlet air path. The drying apparatus also includes an axis to support the desiccant wheel. The drying apparatus also includes a belt to rotate the wheel. The wheel includes a second portion positioned in an outlet air path to transfer energy from heated air to the wheel.

BRIEF DESCRIPTION OF THE DRAWINGS

The accompanying drawings are included to provide further understanding of the invention and constitute a part of the specification. The drawings listed below illustrate embodiments of the invention and, together with the description, serve to explain the principles of the invention, as disclosed by the claims and their equivalents.

DETAILED DESCRIPTION OF THE PREFERRED EMBODIMENTS

Figure 1:
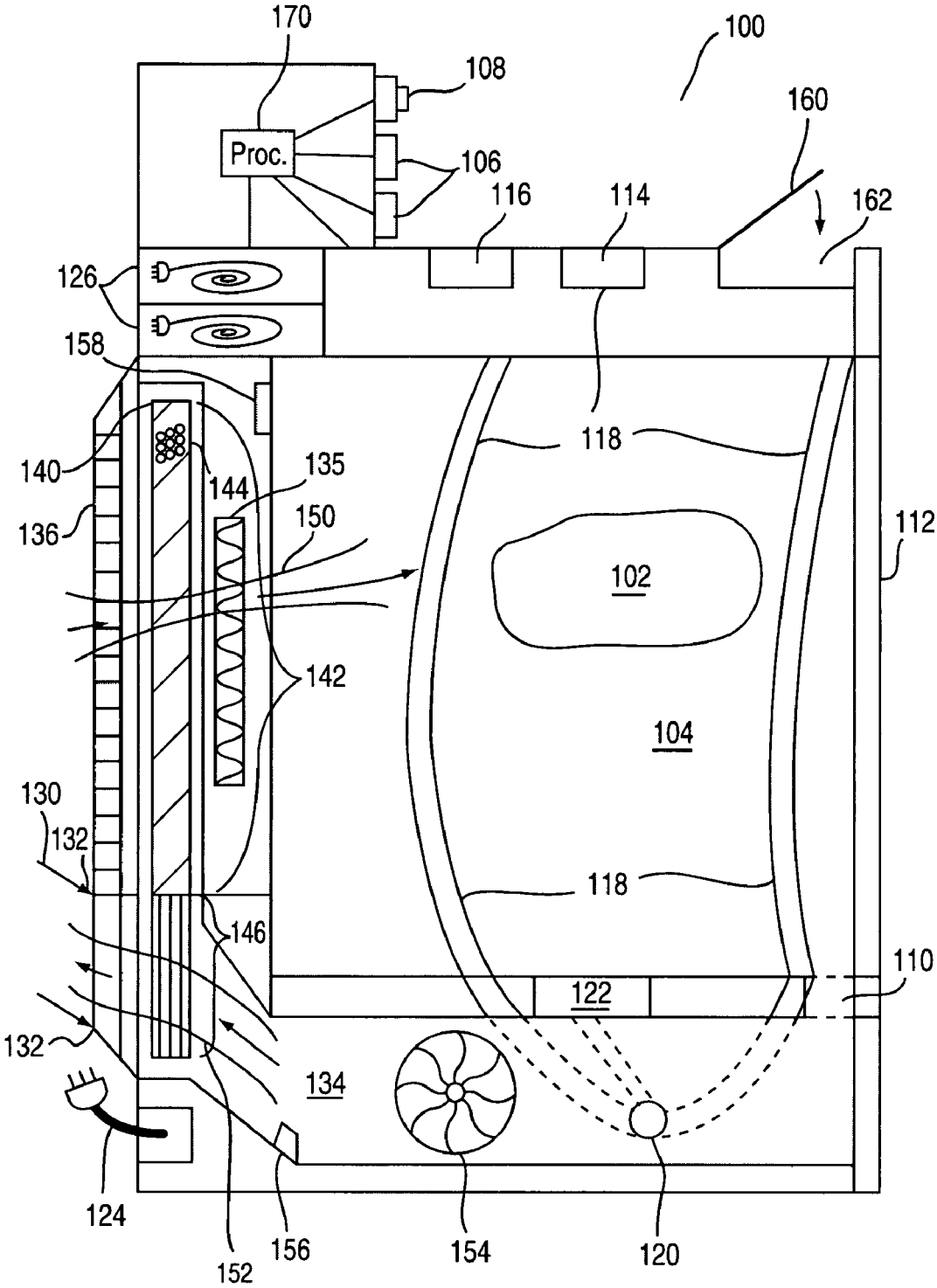
FIG. 1 illustrates a dryer having a desiccant wheel according to the disclosed embodiments.

Aspects of the invention are disclosed in the accompanying description. Alternate embodiments of the present invention and their equivalents are devised without parting from the spirit or scope of the present invention. It should be noted that like elements disclosed below are indicated by like reference numbers in the drawings.

FIG. 1 depicts a dryer 100 having a desiccant wheel 140 according to the disclosed embodiments. Dryer 100 is a dryer using forced, heated air to remove moisture and wetness from articles, such as clothes, towels, fabric, dishes, household items, and the like. Article 102 represents one of such articles, or a plurality of articles, within dryer 102. Preferably, article 102 is contained within a rotating drum 104. Article 102 tumbles within drum 104 to allow the heated air to flow over its surface to remove moisture.

Dryer 100 intakes outside air from its surrounding environment and expels the air after it has cycled through drum 104. This process is disclosed in greater detail below. Dryer 100 also includes controls 106 to adjust settings and operations for drying articles. Controls 106 may be knobs, buttons, displays, and the like. Indicator 108 alerts a user that lint screen 110 should be cleaned. Preferably, indicator 108 is a light that comes on to alert the user.

Dryer 100 also includes door 112. FIG. 1 shows door 112 on the front side of dryer 100, but door 100 may be placed on any side or surface of dryer 100. For example, door 112 may be located on the top of dryer 100 if that side is considered more convenient or accessible. Article 102 is placed into and removed from drum 104 via door 112. Thermostat 114 controls the temperature in drum 104 and uses information provided by sensor 116 to determine whether to increase or decrease the amount of heated air forced onto article 102.

Belts 118 rotate drum 104. Although FIG. 1 shows two belts, the number of belts may vary according to the needs and size of dryer 100. Moreover, other means for rotating drum 104 can be employed and dryer 100 is not limited to using belts. Belts 118 may be attached to a rotor 120. Rotor 120 is controlled by motor 122, which receives commands set by controls 106. Again, rotor 120 and motor 122 may be any configuration or type commonly used in dryers.

Power to dryer 100 is provided via power cord 124. Preferably, power cord 124 includes a 220 volt plug that interacts with a wall outlet. Alternatively, power may be supplied through two 110 volt plugs 126 stored within dryer 100. Plugs 126 provide an alternate power source should the 220 volt plug be unavailable.

Dryer duct 130 couples vent 134 of dryer 100 to the outside. Preferably, duct 130 connects to a vent within a wall. Duct 130 is coupled to dryer 100 using clips 132. Duct 130 may be comprised of rigid material that does not collapse during common use. The rigidity ensures that good air flow occurs at all times while dryer 100 is in use. Backed up air from poor air flow may cause problems within dryer 100.

Lint screen 110 separates drum 104 from vent 134. Vent 134 allows air from drum 104 to exit dryer 100 through duct 130. Fan 154 draws air filled with moisture from article 102 into vent 134. If the air is saturated with moisture, then the removal of moisture from article 102 is compromised. Thus, the air from drum 104 cycles outside dryer 100. Fan 154 sucks the air through lint screen 110, which removes dirt, fluff and other materials from the air so that vent 134 does not become clogged.

Dryer 100 also includes vents 136 that allow air to flow into drum 104. Vents 136 may use small openings to keep foreign objects and materials out of dryer 100. Wheel 140 is placed between vents 136 and drum 104. Heating element 135 heats the air as it enters drum 104 in order to dry article 102. Heating element 135 may be a heater or other device known in the art for heating forced air. Temperatures attainable by heating element 135 may vary according to the desired operation of dryer 100, and may vary as set by controls 106.

Wheel 140 includes compartments filled with silica gel pellets 144. Alternatively, other silica gel products may be used in conjunction with wheel 140. Further, other desiccants may be used with wheel 140. Silica gel pellets 144 act like salt in removing water or moisture from incoming air. The removal, in turn, reduces the vapor pressure of the incoming air, which increases the drying capability of the air. Each pellet includes a strong positive end and strong negative end in its silica molecules. Because the water molecule also acts like a polar molecule, the water in the incoming air is attracted chemically to the silica gel. Thus, the grains of water vapor are reduced in the volume of air coming into dryer 100.

The air flows through wheel 140 at portion 142. Portion 142 includes those parts of wheel 140 having silica gel pellets 144 that remove water from air. Because some of the water vapor of the incoming air will attach to pellets 144, the air flowing into drum 104 is lower in vapor pressure to dry article 102 in a more efficient and timely manner. Conventional clothes dryers use the vapor pressure of the air outside dryer 100, which may not be very suitable for drying articles, such as clothes or towels. The moisture of air within a home, for example, may range from 45 to 110 grains/lb. The vapor pressure of the air being sucked into dryer 100 for heating by heating element 135 determines the time period for article 102 to dry. For example, air having vapor pressure of 110 grains/lb. will not dry article 102 as fast as would air having grains of less than 45 grains/lb.

If the vapor pressure of the incoming air is reduced, then article 102 dries faster. The drying process consumes fewer resources because less energy is needed to evaporate water from article 102. For example, if the vapor pressure of the incoming air is reduced down to about 10 to 40 grains/lb., then article 102 would have a reduced average drying time. Thus, less energy needs to be supplied to heating element 135 and less power to rotate drum 104 according to the disclosed embodiments.

As shown in FIG. 1, portion 142 of wheel 140 is dedicated to the incoming air shown by inlet air path 150. Inlet air path 150 represents all the incoming air through vents 136. Inlet air path 150 also includes air from other parts of dryer 100, such as the front or sides, and is not limited to air flowing through vents 136. Inlet air path 150 also flows through portion 142 and heating element 135 into drum 104.

The air within inlet air path 150 reacts with pellets 144 housed in wheel 140 to remove moisture and water vapor, which, in turn, lowers the vapor pressure of the air prior to heating. Portion 142 houses these pellets. Preferably, portion 142 takes up over half the area of wheel 140 so that most of pellets 144 are reacting with the incoming air. More preferably, portion 142 represents about three quarters (¾) of the surface area of wheel 140.

Portion 146 of wheel 140 is positioned by vent 134 to be exposed to air flowing from drum 104 to duct 130. Outlet air path 152 represents the air expelled from drum 104 via vent 134. Outlet air path 152 flows through portion 146. Preferably, portion 146 is a lower part of wheel 140.

The air within outlet air path 152 regenerates pellets 144 within portion 146. The pellets within portion 146 absorb the heat from outlet air path. Outlet air path 152 includes an air stream with hot air that flowed through heating element 135 and drum 104. Outlet air path 152 burns off water vapor from pellets 144 within portion 146 that was absorbed with positioned in portion 142 from the air in inlet air path 150. The hot air breaks the polar bond attraction between the silica pellet and water vapor molecule. Thus, outlet air path 152 dries out portion 142 of wheel 140. By doing this procedure, pellets 144 can absorb more water vapor when they are moved back to position 142.

The desiccant used within wheel 140 also adds to the efficiency of the drying process by recouping or retaining heat within wheel 140 itself. A percentage of the hot air stream of outlet air path 152 used to burn water off pellets 144 in portion 146 is retained or stored in those pellets, which reacts with the air of inlet air path 150 going through portion 142 prior to flowing through heating element 135. Thus, the disclosed embodiments deliver air having reduced vapor pressure to article 102 in drum 104 to evaporate more water or moisture.

Dryer 100 also includes sensors or other information gathering devices to indicate temperatures, vapor pressure, parameter status, air flow and the like. This information may be forwarded to a processor 170. Processor 170 controls operations of dryer 100 and is coupled to controls 106 and other features. Processor 170 may execute steps or commands within a memory coupled to the processor.

Sensor 158 may be located in the vicinity of inlet air path 150 to determine the temperature of air flowing into drum 104. Based on the need of drum 104, processor 170 can adjust heating element 135 to a desired temperature so that the air in inlet air path 150 enters drum 104 at the desired temperature. Sensor 158 also may detect moisture in the air of inlet air path 150 to determine whether wheel 140 is absorbing water vapor from inlet air path 150.

For example, sensor 158 detects a high level of vapor pressure, or a large amount of moisture, in the incoming air, and this indicates more water vapor in the air than desired. Thus, processor 170 commands wheel 140 to turn to place the saturated pellets 144 into portion 146 for reducing the vapor pressure. Pellets 144 that are located in portion 146 are moved to portion 142 because they are dried out and more absorbent than those pellets in use. The move to position 142 allows the dry pellets to absorb the moisture from air within inlet air path 150. Wheel 140 may be turned using a rotor coupled to a motor or power source that rotates an attached belt. This feature of the present invention is disclosed in greater detail below.

Sensors may also determine status for other areas, such as door 112 being opened. The sensors may comprise any known device used to determine temperature, vapor pressure or other parameters from an environment, especially air. In a basic configuration, sensors 156 and 158 are thermometers that simply relay a temperature reading. Alternatively, sensors 156 and 158 determine vapor pressure, air speed, humidity, force and the like of the air flowing over the respective sensor. Sensors 156 and 158 provide valuable feedback on operating dryer 100 and preventing injury to a user or product. A blast of hot air through door 112 could harm a user, as well as ruining article 102 due to overexposure to heated air.

For example, sensor 158 could indicate a start time to processor 170 for drum 104 to operate. After the time period, sensor 158 takes a reading at inlet air path 150 to make sure heating element 135 and dryer 100 are operating correctly. Sensor 156 is located in vent 134 and may serve the same purposes as sensor 158 by detecting vapor pressure, temperatures, air flow and the like. Sensor 156 may determine the vapor pressure or moisture in the outgoing air, and if it is saturated. If the air includes too much moisture or a high level of vapor pressure, then settings to dryer 100 and, specifically, wheel 140 may be adjusted accordingly.

Dryer 100 also includes a small door 160 to opening 162. Opening 162 accommodates dryer sheets, fabric softener, detergent, and the like placed into drum 104.

Figure 2:
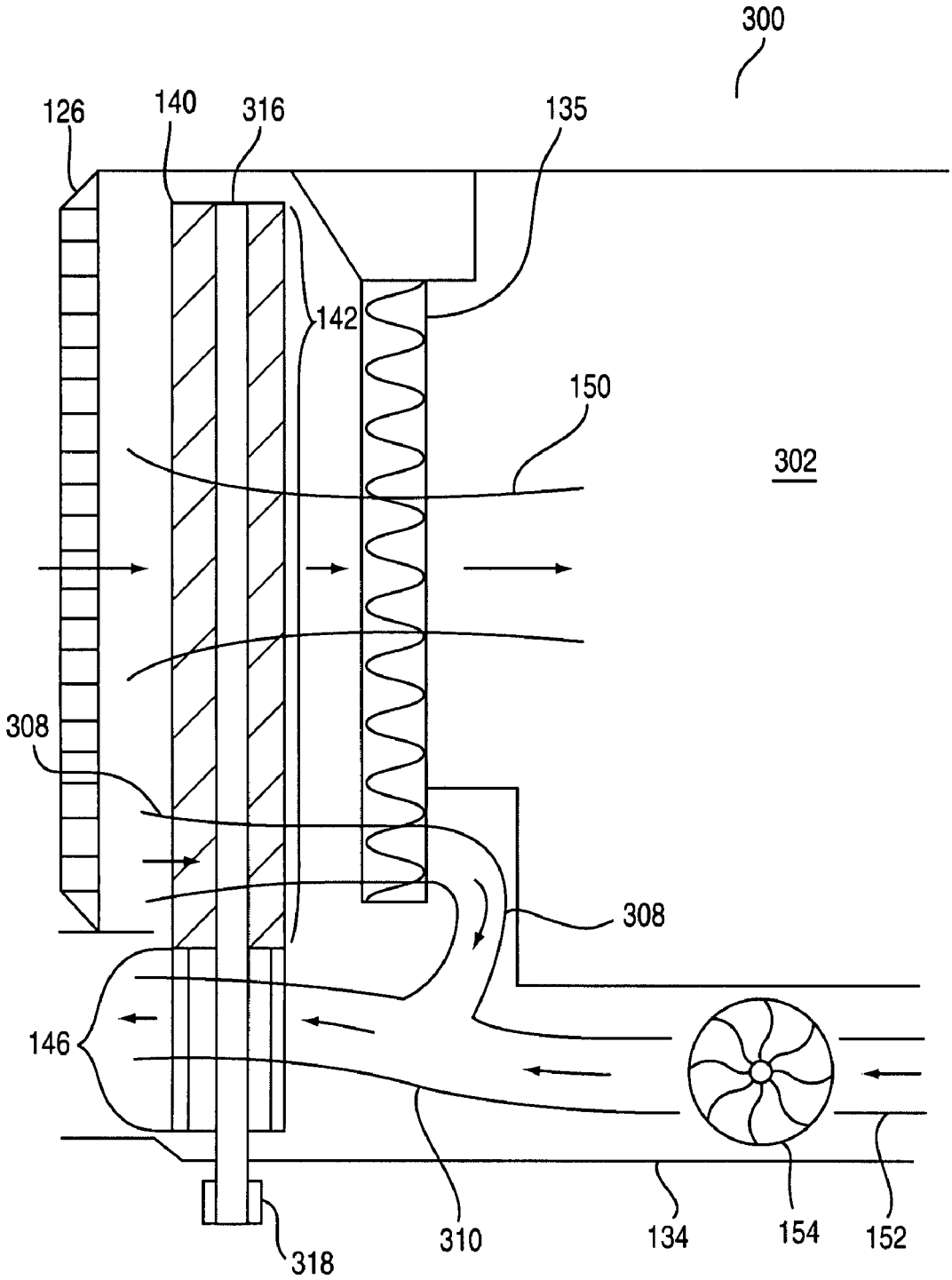
FIG. 2 illustrates another dryer having a desiccant wheel according to the disclosed embodiments.

FIG. 2 depicts another dryer 300 having desiccant wheel 140 according to the disclosed embodiments. Desiccant wheel 140 is similar to the wheel disclosed above, but is shown in dryer 300, which is configured differently than dryer 100 of FIG. 1. Thus, desiccant wheel 140 performs the same as disclosed above in removing moisture from incoming air and lower the vapor pressure of air entering dryer 300.

Wheel 140, however, is shown as including a belt 316 that rotates wheel 140 to its different positions. Motor 318 is attached to belt 316 and rotates wheel 140 as specified. The rotation of wheel 140 allows the pellets to move from the positions of portions 142 and 146 over a period of time. For example, wheel 140 may rotate once every 3 to 8 minutes. Preferably, wheel 140 rotates once about every 5 minutes. Motor 318 may receive power from dryer 300 or include its own power supply.

Belt 316 includes protrusions, or "teeth," that cling to wheel 140 to turn it. Preferably, belt 316 turns wheel 140 in a clockwise direction. Further, the surface area of the pellets with portions 142 and 146 remains constant as wheel 140 moves. Portions 142 and 146 may modify their sizes as needed to increase or reduce absorption of water molecules, or drying out pellets.

Dryer 300 also includes vents 126 that allow air to enter dryer 300. Air also may come from other parts of dryer 300, but preferably, all air sucked into dryer 300 for heating should arrive at wheel 140. Heating element 135 is located in line with wheel 140 to eat incoming air after it passes through the pellets and the water vapor removed, as shown by air path 150. Air from air path 150 flows through portion 142 of wheel 140, heating element 135 and into drum 305 to dry articles, such as article 102 shown in FIG. 1.

Dryer 300, however, also provides an option to create an air path 308 that diverts part of the incoming air directly into vent 134. Air path 308 merges with air path 152 to create outgoing air path 310 that flows through portion 146. The air in air path 308 flows directly from heating element 135 to portion 146 without losing its heat or lower vapor pressure by cycling through drum 302. In other words, a percentage of the energy or heat given off by heating element 135 is transferred to pellets within wheel 140 in a more direct fashion than dryer 100 in FIG. 1.

Preferably, a percentage of the energy or heat from the air flowing directly from heating element 135 is recouped to be used in heating incoming air within inlet air path 150. Thus, portion 146 removes the latent energy from the heated air and portion 142 adds this energy as sensible energy to the incoming air. This feature improves efficiency and reduces costs as more energy or heat is kept within the drying cycle.

Fan 154 sucks air path 152 from drum 302 towards the outside of dryer 300. Alternatively, fan 154 may divert air path 152 from any other area of dryer 300. The air within air path 152 includes moisture taken from articles in drum 302, and should have a higher vapor pressure than the air in air path 308. Thus, the air in air path 308 raises the average temperature and lowers the average vapor pressure when it combines with air path 152 to generate air path 310. The lower average vapor pressure and higher temperature, in turn, facilitates drying out portion 146 of wheel 140. Air path 310 exits dryer 300 normally.

Thus, the disclosed embodiments allow for an option to combine heated air having a lower vapor pressure with cycled air being expelled. Dryer 300 also may be configurable to allow both options, such as closing off air path 308 and forcing all air going through heating element 135 to flow into drum 302.

Figure 3:
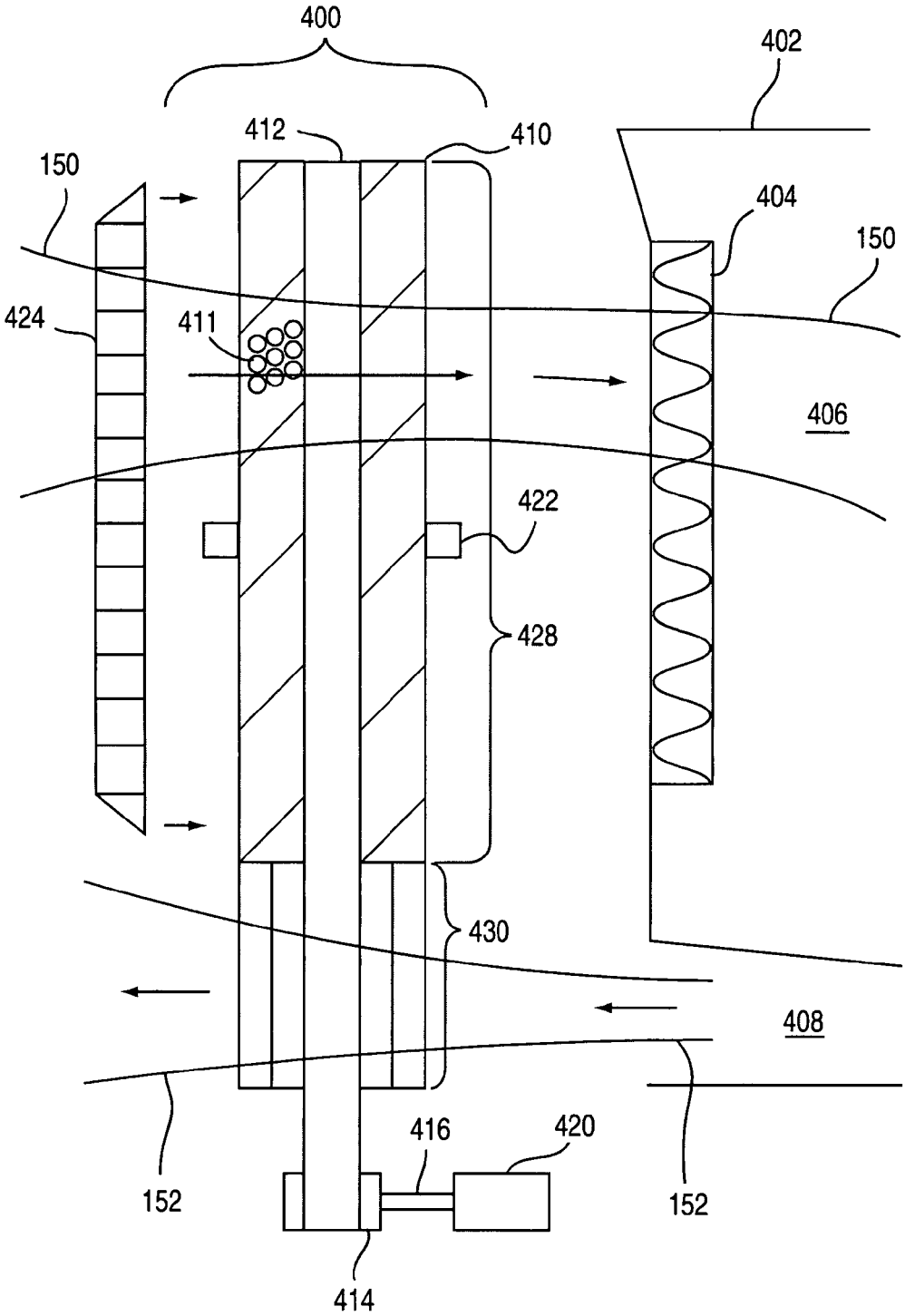
FIG. 3 illustrates a drying apparatus according to the disclosed embodiments.

FIG. 3 depicts a drying apparatus 400 attachable to a dryer 402 according to the disclosed embodiments. Drying apparatus 400 is distinguishable from FIGS. 1 and 2 as it is attached to an existing dryer to enable better moisture removal and to lower vapor pressure of air used to dry articles.

For example, drying apparatus 400 can be attached to existing dryers in a commercial laundry room, or laundromat, to reduce energy costs and make drying operations more efficient. Thus, the existing dryers are not majorly refitted or replaced.

Drying apparatus 400 attaches to dryer 402. Dryer 402 includes heating element 404 and drum 406. Drum 406 contains articles that are dried by forced air. Incoming air flows through heating element 404 via inlet air path 150 to dry the articles. Outgoing air expels from dryer 402 via outlet air path 152 through vent 408.

Drying apparatus 400 includes wheel 410. Wheel 410 includes pellets 411 that are used to dry out or lower the vapor pressure of incoming air within inlet air path 150 prior to entering drum 406. Wheel 410 rotates about axis 422. Belt 412 wraps about wheel 410 to rotate it using motor 414. Coupling 416 connects to power supply 420 to provide power to motor 414. Alternatively, motor 414 gets power from dryer 402 or a motor associated with dryer 402 connects to drying apparatus 400 to turn belt 412.

Wheel 410 includes two portions 428 and 430. Portion 428 acts like portion 142 disclosed above. Portion 430 acts like portion 146 disclosed above. Incoming air within inlet air path 150 flows through portion 428 and reacts with pellets 411 to remove water molecules and, in turn, lowers the vapor pressure of the air. Outgoing air within outlet air path 152 flows through portion 430, and transfers some of the heat of the outgoing air to pellets 411 in the lower portion. When wheel 410 rotates using belt 412, pellets 411 in portion 430 are positioned in portion 428. Thus, drying apparatus is able to retain some of the energy expended to dry articles in dryer 402.

When attaching to dryer 402, drying apparatus 400 is positioned in line with heating element 404. Air exiting drying apparatus 400 is heated by heating element 404. Drying apparatus 400 may be positioned elsewhere on dryer 402 but better water vapor removal occurs when wheel 410 is in line and close in proximity to heating element 404. Further, as shown in FIG. 4 below, dryer 402 may be configured to divert part of the air flowing through heating element 404 into vent 408 so that portion 430 receives air having a higher temperature and lower vapor pressure than the air flowing through vent 408.

Figure 4:
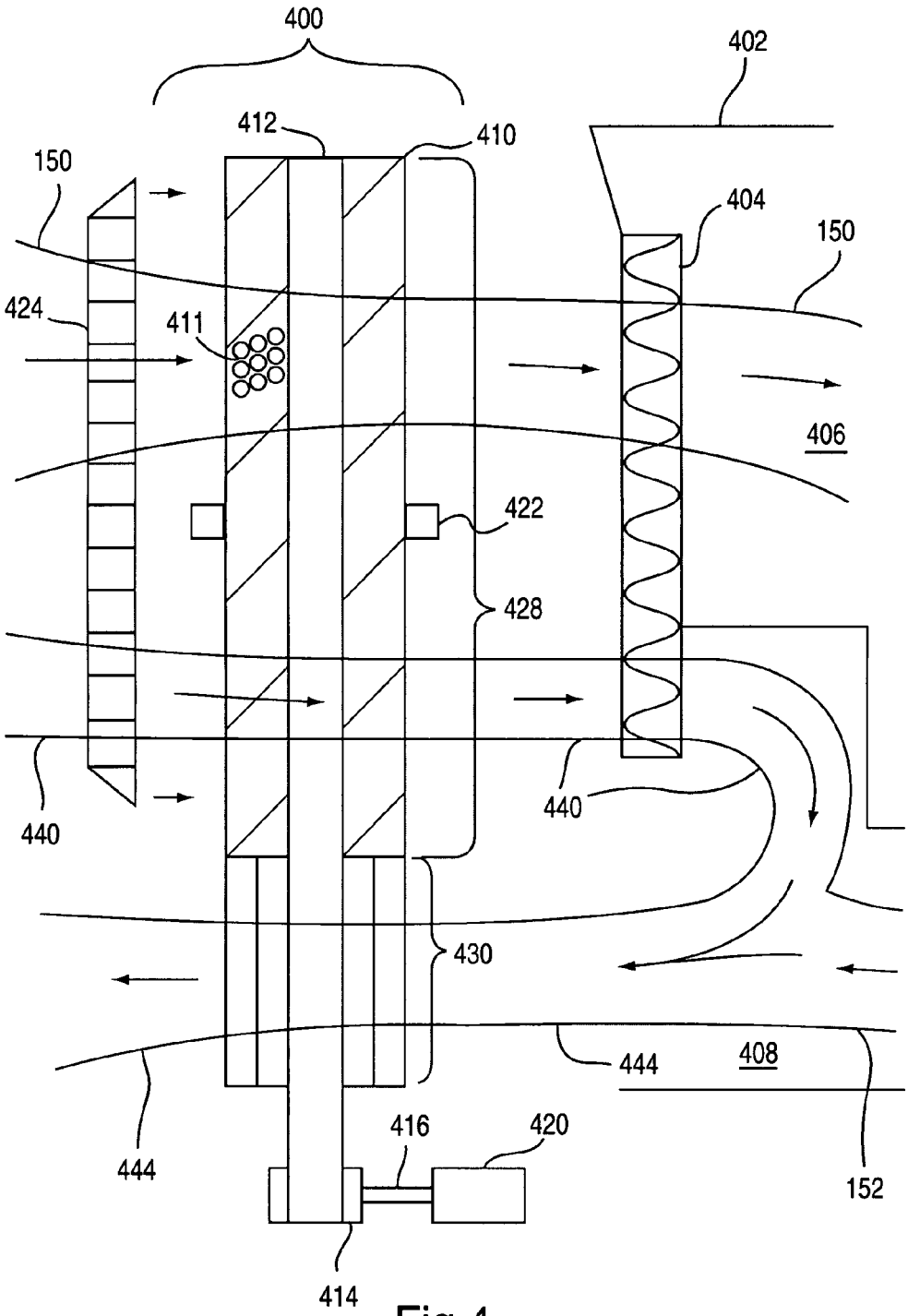
FIG. 4 illustrates another configuration for a drying apparatus according to the disclosed embodiments.

FIG. 4 depicts another configuration for drying apparatus 400 according to the disclosed embodiments. Drying apparatus 400 of FIG. 4 is very similar to drying apparatus of FIG. 3. Incoming air flows through inlet air path 250 into dryer 402 through portion 428.

Outlet air path 15, however, is changed into outlet air path 444 by diverted air path 440. As with FIG. 2, heated air is diverted directly from heating element 404 back to wheel 410. The air within diverted air path 444 does not flow through dryer 402 to loose it effectiveness. Plus, diverted air path 444 and its highly heated air can transfer heat and/or energy to wheel 410 by drying out the pellets located in portion 430. Thus, some of the heat generated by heating element 404 can be retained to improve moisture removal.

As wheel 410 rotates, pellets 411 in portion 430 reposition to portion 428. The heat or energy absorbed by those pellets is transferred to the air in inlet air path 150. Thus, drying apparatus 400 facilitates the transfer of heat or energy from heating element 404 to incoming air to further heat the air. Moreover, some of the heat or energy is conserved by diverting air directly from heating element 404.

If vent 408 does not line up exactly with portion 430 of wheel 410, then an extension or duct may be attached to dryer 402 to further divert the heated air to portion 430. Other features may be included on drying apparatus 400 to attach its parts to dryer 402 to ensure proper alignment of the air paths.

Figure 5:
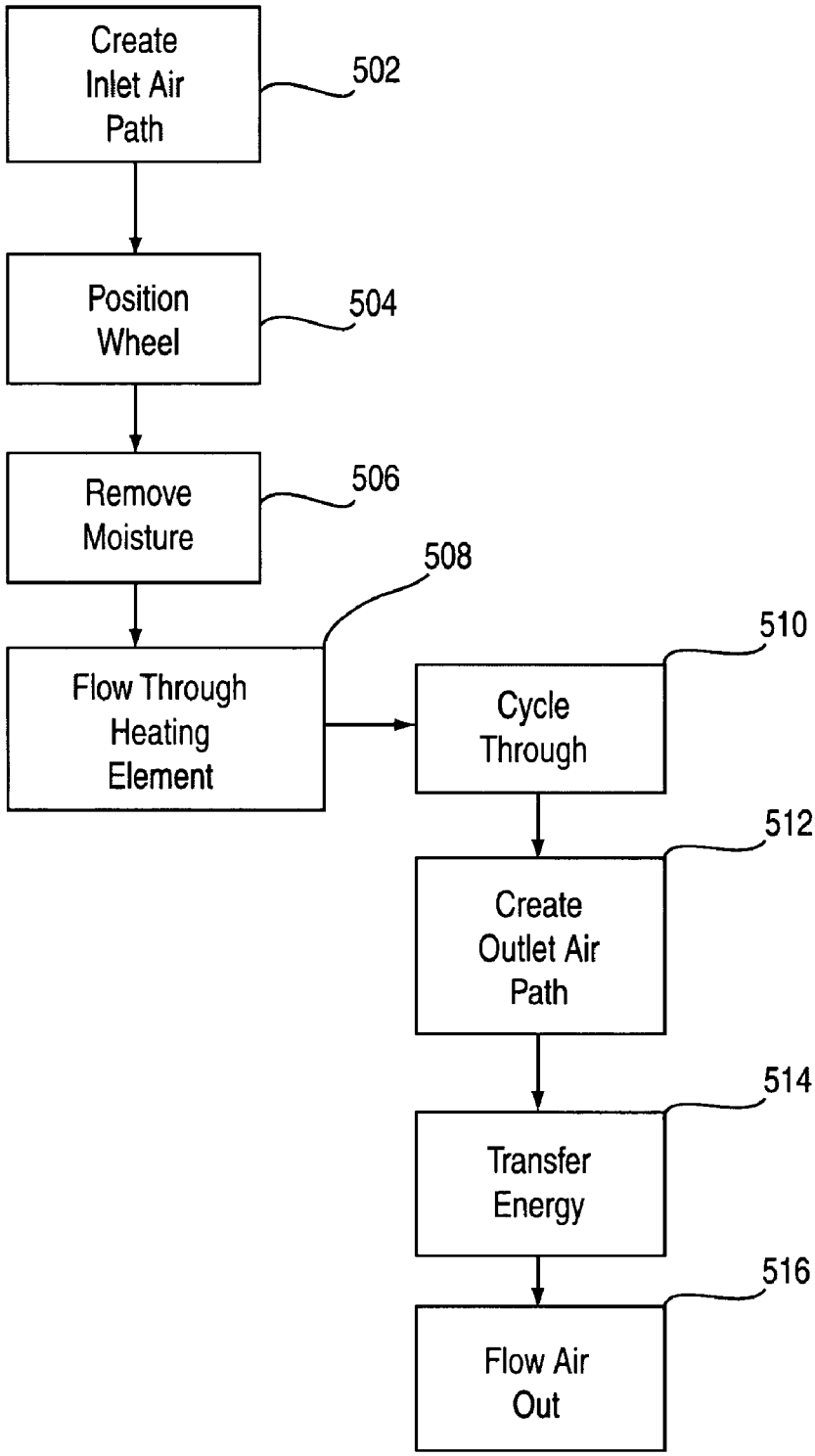
FIG. 5 illustrates a flowchart for drying according to the disclosed embodiments.

FIG. 5 depicts a flowchart for drying according to the disclosed embodiments. The flowchart embodies the steps and features desired to execute various methods and processes to accomplish the present invention. Reference will be made to the features of FIG. 1 during the description of FIG. 5.

Step 502 executes by creating inlet air path 150 in dryer 100. Inlet air path 150, as disclosed above, brings air from outside dryer 100 into drum 104 for use in drying article 102. The air within inlet air path 150 may vary in terms of temperature, vapor pressure, moisture or water vapor content and the like. Further, inlet air path 150 flows through vents 136, wheel 140 and heating element 135.

Step 504 also executes by positioning wheel 140. As disclosed above, wheel 140 rotates so that its surface area and pellets 144 are positioned in inlet air path 150 and outlet air path 152. Thus, portions 142 and 146 of wheel 140 lay within the flow of inlet air path 150 and outlet air path 152, respectively. Wheel 140 rotates when needed. Further, wheel 140 may rotate to move part of its surface area in portion 146 to portion 142 so that pellets having heat or energy from outlet air path 152 can be transferred to the incoming air. Preferably, wheel 140 rotates once every five minutes. The rotation period, however, is not limited to five minutes, and may be any length of time desired.

Step 506 executes by removing water molecules from the air within inlet air path 150 using pellets 144. This action, in turn, reduces the vapor pressure of the air in inlet air path 150. Step 508 executes by flowing air through heating element 135 to provide heated air into dryer 100. The incoming air passes through heating element 135 after flowing through wheel 140. In this manner, heating the air and removing water molecules, vapor, moisture and the like are two separate actions.

Step 510 executes by cycling through the drying process in dryer 100 by allowing air from inlet air path 150 into drum 104. In drum 104, the air dries out article 102. Step 512 executes by creating an outlet air path 152 in dryer 100. Step 512 is applicable as the air leaves drum 104 with moisture and water vapor from article 102.

Step 514 executes by transferring energy from the air in outlet air path 152 to pellets in wheel 140. As disclosed above, the air coming from dryer 100 is heated and includes energy that can be absorbed by the pellets. This energy can be in the form of heat, such that the pellets in wheel 140 absorb the heat as the air passes over them. Preferably, the pellets remove the latent energy from the air so that they can add this energy as sensible energy to incoming air. The act of transferring also may be known as recouping the energy or heat from the outgoing air. This feature allows the drying process to be more efficient and to reduce energy costs. Step 516 executes by flowing the air out of wheel 140 and to the outside.

Despite basing the description of FIG. 5 on Figure, the disclosed embodiments are not limited to dryer 100. FIG. 5 is applicable to any configuration of a dryer or drying apparatus, and equally applies to the embodiments disclosed by FIGS. 2-4. The steps disclosed above can be executed on a wheel within a dryer or one attached to an existing dryer as a separate apparatus.

Thus, the disclosed embodiments of the present invention includes a dryer having different configurations and a drying apparatus attachable to conventional dryers to enhance moisture removal from incoming air. The disclosed embodiments include a wheel having a desiccant that rotates to different positions so that different portions of the wheel in the path of incoming and outgoing air. Use of the refrigerant is more efficient because the removed moisture is burned off by outgoing air. Further, the disclosed embodiments take advantage of the existing heating element in a dryer to enhance the incoming air and lower vapor pressure.

The disclosed embodiments are preferably used in open system dryers that have air brought in from outside the dryer. Thus, the air from the environment surrounding the dryer may include saturated or air having a high vapor pressure. The disclosed embodiments help to lower the vapor pressure of the incoming air using the wheel and its desiccant. Thus, no matter what the air is like outside of the dryer, the disclosed embodiments can lower the vapor pressure to a specified, acceptable level.

Moreover, the disclosed embodiments do not have to be run at all times that the dryer is running. For example, a sensor can detect bad drying conditions for the incoming air and activate the drying apparatus.

The disclosed embodiments also are applicable to other drying processes beyond contemporary dryers. For example, a desiccant wheel may be set up to dry out a room or enclosed space of a building having severe moisture damage. Air is pumped, or forced, through an upper portion of the wheel prior to entering the room so as to lower the vapor pressure of the air within the room. Air also is forced out of the room to remove moisture or water that has evaporated within the room to an outside environment. Much like the outgoing air path disclosed above, this outgoing air serves to transfer heat or energy to the wheel and to regenerate the moisture removal capabilities of the wheel.

The disclosed embodiments of the present invention, however, are applicable to dryers in a household or laundry setting, where air is drawn from and returned to the outside environment. The present invention, however, is not limited to these dryers and may be applicable to any situation where an article needs to be dried using forced air. The air is heated and the moisture removed by the desiccant wheel. The vapor pressure of the incoming air is lowered to enhance moisture removal.

It will be apparent to those skilled in the art that various modifications and variations can be made in the disclosed embodiments of the present invention without departing from the spirit or scope of the invention. Thus, it is intended that the present invention covers the modifications and variations of the embodiments disclosed above provided that they come within the scope of any claims and their equivalents.

What is claimed is:

1. A method for enhancing moisture removal in a drying system, the method comprising: positioning a desiccant within a wheel in an open dryer into an inlet air path for bringing in air outside the dryer; removing at least one water molecule from the air within the inlet air path; heating the air within the inlet air path with a heating element to form a first portion and a second portion of heated air; cycling the first portion of the heated air through a drum; and transferring energy from the first portion of the heated air within an outlet air path from the drum and from the second portion of the heated air directly from the heating element to the desiccant to facilitate the removing step.

2. The method of claim 1, further comprising creating the inlet air path that flows through a first portion of the wheel.

3. The method of claim 1, further comprising creating the outlet air path that flows through the wheel at a second portion.

4. The method of claim 3, wherein the second portion comprises less than half a surface area of the wheel.

5. The method of claim 1, further comprising reducing vapor pressure of air within the inlet air path.

6. The method of claim 1, further comprising expelling the heated air to outside the open dryer after the heated air passes through the desiccant.

7. The method of claim 1, further comprising expelling the heated air outside the dryer.

8. A method for enhancing moisture removal in an open drying system, the method comprising:

creating an inlet air path to draw air from outside the open drying system;

reducing the vapor pressure of the air within the inlet air path using a desiccant wheel;

heating the air within the inlet air path;

cycling a first portion of the heated air into a drum within the open drying system, wherein the drum holds at least one article;

creating an outlet air path to flow saturated or moist heated air of the first portion from the drum;

flowing a second portion of the heated air directly from a heater in the inlet air path to the bottom portion of the desiccant wheel;

transferring latent energy from the saturated or moist heated air of the first portion and the second portion of the heated air to a bottom portion of the desiccant wheel; and expelling the saturated or moist heated air outside the open drying system.

* * * * *